US006729237B2

(12) United States Patent
Kawamura et al.

(10) Patent No.: US 6,729,237 B2
(45) Date of Patent: May 4, 2004

(54) DEVICE FOR REMOVING IMAGE RECORDING MATERIAL

(75) Inventors: Yoshinori Kawamura, Kanagawa (JP); Tsukasa Ono, Kanagawa (JP); Kazuoki Komiyama, Kanagawa (JP); Takashi Koizumi, Kanagawa (JP); Yoshihiro Koyanagi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/314,307

(22) Filed: Dec. 9, 2002

(65) Prior Publication Data

US 2003/0106449 A1 Jun. 12, 2003

(30) Foreign Application Priority Data

Dec. 12, 2001 (JP) ..... 2001-378460

(51) Int. Cl.[7] ..... B65H 3/08; B65H 3/46

(52) U.S. Cl. ..... 101/477; 101/401.1; 347/264; 271/11; 271/98; 271/107

(58) Field of Search ..... 101/477, 401.1, 101/483; 347/264, 262; 271/10.01, 11, 97, 98, 105, 107, 104, 275, 276; 414/797, 797.2

(56) References Cited

U.S. PATENT DOCUMENTS

| | | | | | |
|---|---|---|---|---|---|
| 4,212,263 | A | * | 7/1980 | Hillhouse | 118/37 |
| 4,402,592 | A | * | 9/1983 | Schon et al. | 399/166 |
| 4,667,948 | A | * | 5/1987 | Angelbeck et al. | 271/98 |
| 5,367,360 | A | * | 11/1994 | McIlwraith et al. | 355/85 |
| 2003/0170099 | A1 | * | 9/2003 | Ono | 414/416.01 |

* cited by examiner

*Primary Examiner*—Leslie J. Evanisko
(74) *Attorney, Agent, or Firm*—Taiyo, Nakajima & Kato

(57) ABSTRACT

A device for removing an image recording material is provided, which takes up little space and is used with printing plates and interleaf sheets set alternately in a cassette. An interleaf sheet and a printing plate are taken out simultaneously. In the midst of being conveyed along a conveying path leading to an exposure section, only the interleaf sheet is sucked by a fan or drawn-in between a roller pair so as to be peeled off from the printing plate. The peeled-off interleaf sheet is discarded, and the printing plate is conveyed reliably to the exposure section.

16 Claims, 7 Drawing Sheets

DEVICE FOR REMOVING IMAGE RECORDING MATERIAL

BACKGROUND OF THE INVENTION

1. Field of the Invention

The present invention relates to a device for removing an image recording material in order to feed image recording materials to a subsequent process. The removing device has a cassette which accommodates image recording materials, in which an image recording surface is provided on a support, and interleaf sheets, which are thin-film-like and which protect the image recording surface, in a state in which the image recording materials and the interleaf sheets are alternately stacked. The interleaf sheets which are accommodated in the cassette are discarded.

2. Description of the Related Art

A technique (printing plate exposure device) has come to be developed which, by using an image recording material (printing plate) in which an image recording surface (photosensitive layer) is provided on a support, records an image directly by a laser beam or the like onto an emulsion surface which serves as the photosensitive layer of the printing plate. With such a technique, it is possible to quickly record an image onto a printing plate.

In an automatic printing plate exposure device using a technique of recording an image onto a printing plate, the printing plates are removed one-by-one (separated/removed) from a cassette in which a plurality of the printing plates are stacked, and are fed to an exposure section.

Here, when the printing plates are stacked in the cassette, in order to prevent the emulsion surfaces thereof from being scratched, interleaf sheets, which are thin-film-like protective sheets, are inserted between the printing plates. Thus, within the cassette, the printing plates and the interleaf sheets are stacked alternately.

The interleaf sheet has the important function of protecting, in particular, the emulsion surface of the printing plate. However, the interleaf sheet is not needed during exposure in the exposure section. Therefore, the interleaf sheet must be taken off of the printing plate by the time the printing plate is removed from the cassette and reaches the exposure section.

Further, the printing plates are separated/removed from the cassette by using suction cups. Because it is easy for the emulsion surface of the printing plate to be scratched, when the printing plate is separated/removed from the cassette by using suction cups or the like, the printing plates are accommodated in the cassette with the reverse surfaces thereof facing upward, and are taken out by the suction cups being made to directly contact the reverse surfaces. On the other hand, when it is presumed that the emulsion surface faces upward in the exposure section, it is necessary to provide a mechanism which inverts by 180° the printing plate which has been taken out from the cassette.

Further, when the printing plate is removed from the cassette, the material which exists next as the uppermost layer in the cassette is an interleaf sheet. The interleaf sheet must be removed by a different mechanism, and via a different path. The current situation is that the printing plates and the interleaf sheets are separated/removed separately from the cassette.

In this way, there are various restrictions on conventional removing devices which convey printing plates from the cassette to the exposure section, such as the removing device must be disposed above the reverse surface of the printing plate in order to protect the emulsion surface, and the interleaf sheet must be removed from the cassette by a separate mechanism, and the like. A complex structure is therefore needed.

SUMMARY OF THE INVENTION

In view of the aforementioned, an object of the present invention is to provide a device for removing an image recording material which, without dividing the functions of removing image recording materials and removing interleaf sheets, and without scratching the image recording surfaces of the image recording materials, can convey only the image recording materials to a subsequent process.

The present invention is an image recording material removing device which feeds an image recording material out to a subsequent process from a cassette which accommodates, in an alternately stacked state, image recording materials, in each of which an image recording surface is provided on a support, and interleaf sheets, each of which is thin-film-like and protects the image recording surface. The image recording material removing device comprises a take-out device, a conveying device, a peeling device, and an interleaf sheet discarding device. The take-out device simultaneously takes out from the cassette a pair of the image recording material and the interleaf sheet in a state in which the interleaf sheet is superposed on top of the image recording material. The conveying device conveys the image recording material and the interleaf sheet, which have been taken out by the take-out device, along a predetermined conveying path to the subsequent process. The peeling device peels the interleaf sheet from the image recording material while the interleaf sheet and the image recording material, which have been simultaneously taken-out, are in the midst of being conveyed along the conveying path to the subsequent process by the conveying device. The interleaf sheet discarding device discards the interleaf sheet, which has been peeled off, along a path which is different from the conveying path to the subsequent process.

In accordance with the present invention, the take-out device simultaneously takes out an interleaf sheet and an image recording material from the cassette in which the interleaf sheets and the image recording materials are alternately stacked with the respective interleaf sheets on top of the respective image recording materials (or with the respective image recording materials on top of the respective interleaf sheets). Namely, the image recording material and the interleaf sheet are taken out as a pair from the cassette.

The conveying device conveys the image recording material and the interleaf sheet, which have been taken-out simultaneously, in a state in which the two are superposed. Along the conveying path, the interleaf sheet is peeled off from the image recording material by the peeling device. Only the image recording material is fed out to the subsequent process, and the interleaf sheet is discarded by the interleaf sheet discarding device.

In this way, by simultaneously taking out the image recording material and the interleaf sheet from the cassette, a single mechanism for taking out suffices, and the structure can be made more simple. Further, by taking the image recording material and the interleaf sheet out simultaneously, the period of time over which the image recording surface is protected can be lengthened.

In the present invention, the take-out device may have a suction cup which simultaneously sucks the interleaf sheet and the image recording material, and a moving device which makes the suction cup approach and move away from the cassette.

In the case of such a structure, although it depends on the properties of the interleaf sheet, the suction cup is pressed against the interleaf sheet from the obverse surface thereof and sucks the interleaf sheet. In this way, the interleaf sheet and the image recording material which is the next layer (the layer immediately beneath the interleaf sheet) can be taken-out simultaneously. At this time, there are cases in which the interleaf sheet and the image recording material which are further beneath stick, due to static electricity, to the image recording material which is to be taken out. However, for example, the interleaf sheet and the image recording material which are sticking can be separated by a separating plate from the image recording material which is to be taken out.

Regardless of whether or not the take-up device is structured as per the above-described specific example thereof, there are cases in the present invention in which the image recording material, which was accommodated in the cassette with the image recording surface facing upward and which has been taken out by the take-out device, is conveyed to the subsequent process by the conveying device in a state in which the orientation of the image recording material is maintained.

In this case, when the image recording material and the interleaf sheet are taken-out simultaneously, because the interleaf sheet is the uppermost layer, even if the top surface is sucked by a suction cup or the like, the image recording surface is not scratched. Note that, when the interleaf sheet which is the topmost layer is sucked by a suction cup, the image recording material which is beneath the interleaf sheet can be sucked simultaneously due to the properties of the interleaf sheet.

Because the image recording surface can be set facing upward, it is advantageous in cases in which, for example, the image recording material is to be processed in the subsequent process with its image recording surface facing upward.

Regardless of whether or not the take-up device is structured as per the above-described specific example thereof, there are cases in the present invention in which the image recording material, which was accommodated in the cassette with the image recording surface facing downward and which has been taken out by the take-out device, is conveyed to the subsequent process by the conveying device in a state in which the orientation of the image recording material is inverted.

In this case, an existing removing device has a mechanism for inverting the image recording material removed from a cassette. Therefore, when used in such a device, the image recording material is set with its reverse surface facing upward as in the conventional art. In such cases as well, the image recording material is taken-out with an interleaf sheet, with which the image recording material was alternately stacked within the cassette, being disposed on top of the image recording material. Namely, the image recording material is taken out in a state in which the interleaf sheet exists at the reverse surface of the image recording material which is stacked together with the interleaf sheet. However, in the midst of being conveyed along the conveying path (which includes the inverting mechanism), the interleaf sheet is peeled off and is discarded. Therefore, a mechanism for removing the interleaf sheet, which is used in existing devices, can be eliminated.

In the present invention, in any of the above-described cases, due to the peeling device separating the interleaf sheet from the image recording material by suction force by air, the interleaf sheet is peeled off from the image recording material.

In this case, air due to by driving of a fan or the like is utilized as the peeling device. Because the interleaf sheet is thin-film-like, by setting the fan to oppose the interleaf sheet and by sucking the interleaf sheet up by the fan, the interleaf sheet can easily be peeled off from the image recording material.

In this case, after the interleaf sheet has been sucked up by the fan (i.e., has been peeled off), the interleaf sheet is nipped by a pair of rollers or the like which serves as the interleaf sheet discarding device, and is discarded. Therefore, the force of the fan, which sucks the interleaf sheet up, alone is impetus for peeling of the interleaf sheet off from the image recording material.

DETAILED DESCRIPTION OF THE EMBODIMENTS (First Embodiment)

Figure 1:
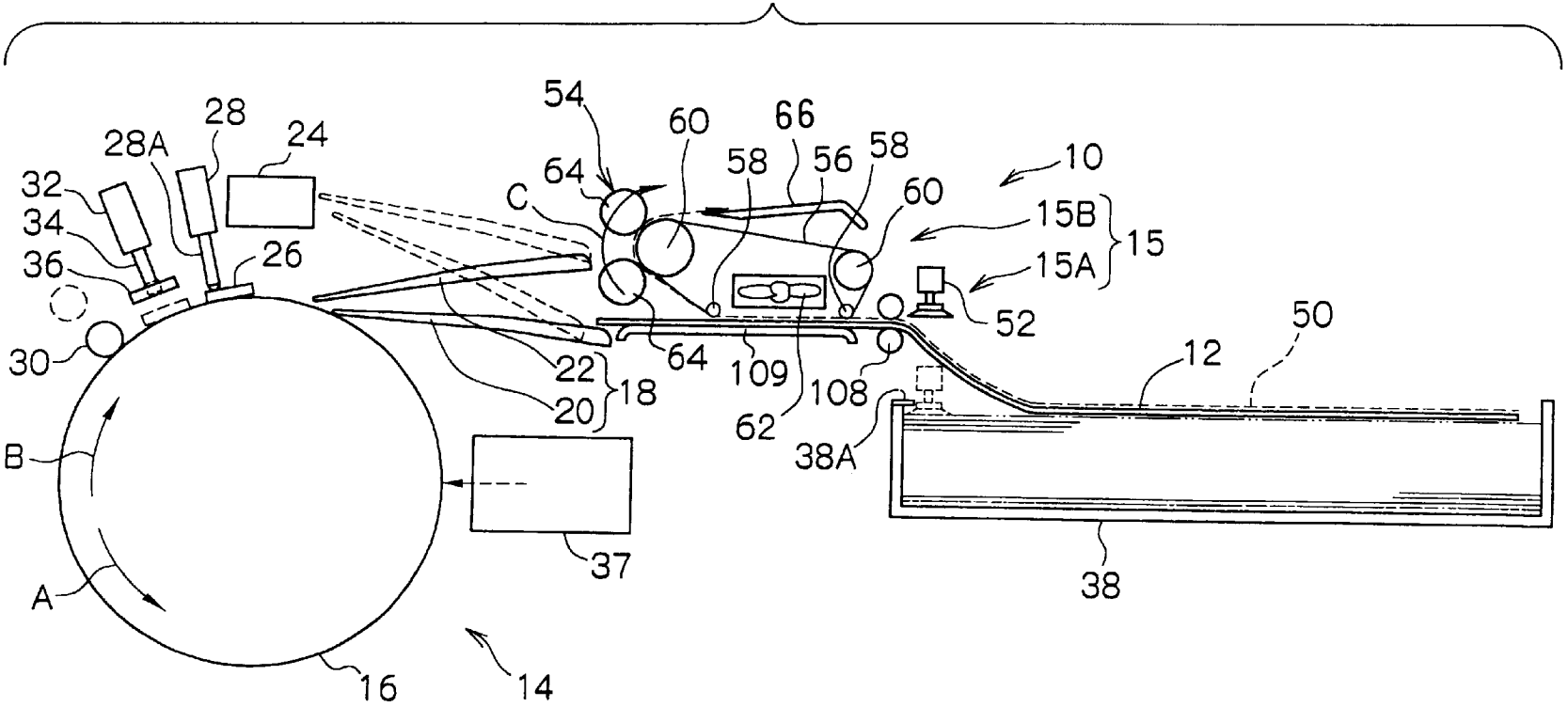
FIG. 1 is a schematic diagram of an automatic printing plate exposure device relating to a first embodiment.

An automatic printing plate exposure device 10 relating to a first embodiment is shown in FIG. 1.

The automatic printing plate exposure device 10 is divided into two main sections which are an exposure section 14, which irradiates a light beam onto an image forming layer of a printing plate 12 so as to expose an image, and a removing/conveying section 15 which separates/removes the printing plate 12 and conveys the printing plate 12 to the exposure section 14. The printing plate 12 is one example of an image recording material. The printing plate 12, which has been subjected to exposure processing by the automatic printing plate exposure device 10, is fed out to a developing device (not illustrated) which is disposed adjacent to the automatic printing plate exposure device 10.

(Structure of Exposure Section)

The exposure section 14 is structured such that a rotating drum 16, around whose peripheral surface the printing plate 12 is trained and held, is the main portion of the exposure section 14. The printing plate 12 is guided by a conveying guide unit 18, and is fed into the exposure section 14 from a direction tangential to the rotating drum 16. The exposure section 14 is the subsequent process with respect to the removing/conveying section 15. The conveying guide unit 18 is structured by a plate supplying guide 20 and a plate discharging guide 22. Conveying rollers 108 and a guide plate 109 are disposed at the side of the conveying guide unit 18 which side borders on the removing/conveying section 15.

The relative positional relationship of the plate supplying guide 20 and the plate discharging guide 22 of the conveying guide unit 18 is such that the plate supplying guide 20 and the plate discharging guide 22 form a sideways V shape. The plate supplying guide 20 and the plate discharging guide 22 rotate by predetermined angles around the right end portion sides thereof in FIG. 1. Due to this rotation, the plate supplying guide 20 and the plate discharging guide 22 can selectively be made to correspond to the rotating drum 16 (i.e., can be disposed in a direction tangential to the rotating drum 16).

A puncher 24 is disposed in a vicinity of the conveying guide unit 18. By making the plate supplying guide 20 oppose the puncher 24, the leading end of the printing plate 12 can be made to enter into the puncher 24.

The printing plate 12 which has been fed out from the removing/conveying section 15 is first guided by the plate supplying guide 20 and fed into the puncher 24 where notches for positioning are formed in the leading end of the printing plate 12.

After the printing plate 12 undergoes processing at the puncher 24, the printing plate 12 is returned to the plate supplying guide 22. The printing plate 12 is thereby moved to a position corresponding to the rotating drum 16.

The rotating drum 16 is rotated by an unillustrated driving means in a direction in which the printing plate 12 is attached and exposed (the direction of arrow A in FIG. 1), and in a direction in which the printing plate 12 is removed (the direction of arrow B in FIG. 1) which is opposite to the attaching/exposing direction.

As shown in FIG. 1, a leading end grasping portion 26 is mounted to a predetermined position of the outer peripheral surface of the rotating drum 16 provided in the exposure section 14. At the exposure section 14, when the printing plate 12 is to be attached to the rotating drum 16, first, the rotating drum 16 is stopped at a position (printing plate attaching position) at which the leading end grasping portion 26 opposes the leading end of the printing plate 12 which has been fed in by the plate supplying guide 20 of the conveying guide unit 18.

An attaching unit 28 is provided in the exposure section 14 so as to oppose the leading end grasping portion 26 at the printing plate attaching position. Due to an extending/retracting rod 28A of the attaching unit 28 extending and one end side of the leading end grasping portion 26 being pushed, the printing plate 12 can be inserted between the leading end grasping portion 26 and the peripheral surface of the rotating drum 16.

In the exposure section 14, in the state in which the leading end of the printing plate 12 is inserted between the leading end grasping portion 26 and the rotating drum 16, the extending/retracting rod 28A of the attaching unit 28 is pulled back such that the pressing of the leading end grasping portion 26 is released. In this way, the leading end of the printing plate 12 is nipped and held between the leading end grasping portion 26 and the peripheral surface of the rotating drum 16.

At this time, the printing plate 12 is positioned due to the leading end thereof abutting a positioning pin (not shown) provided on the rotating drum 16.

At the exposure section 14, when the leading end of the printing plate 12 is fixed to the rotating drum 16, the rotating drum 16 is rotated in the attaching/exposing direction. In this way, the printing plate 12, which has been fed in from the plate supplying guide 20 of the conveying guide unit 18, is trained about the peripheral surface of the rotating drum 16.

A squeeze roller 30 is provided at the downstream side, in the attaching/exposing direction, of the printing plate attaching position, in a vicinity of the peripheral surface of the rotating drum 16. Due to the squeeze roller 30 moving toward the rotating drum 16, the printing plate 12 which is trained on the rotating drum 16 is pushed toward the rotating drum 16 and is made to fit tightly to the peripheral surface of the rotating drum 16.

Further, a trailing end grasping portion attaching/removing unit 32 is disposed in the exposure section 14 in a vicinity of the downstream side of the squeeze roller 30 in the attaching/exposing direction of the rotating drum 16. At the trailing end grasping portion attaching/removing unit 32, a trailing end grasping portion 36 is mounted to the distal end of a shaft 34 which projects toward the rotating drum 16.

In the exposure section 14, when the trailing end of the printing plate 12 which is trained on the rotating drum 16 opposes the trailing end grasping portion attaching/removing unit 32, the shaft 34 is extended such that the trailing end grasping portion 36 is attached to a predetermined position of the rotating drum 16. In this way, the trailing end of the printing plate 12 is nipped and held between the trailing end grasping portion 36 and the rotating drum 16.

In the exposure section 14, when the leading end and the trailing end of the printing plate 12 are held at the rotating drum 16, the squeeze roller 30 is moved away. Thereafter, in the exposure section 14, while rotating the rotating drum 16 at high speed at a predetermined rotational speed, a light beam, which is modulated on the basis of image data, is irradiated from a recording head portion 37 synchronously with the rotation of the rotating drum 16. In this way, the printing plate 12 is scan-exposed on the basis of the image data.

In the exposure section 14, when the scan-exposure of the printing plate 12 has been completed, the rotating drum 16 is temporarily stopped at a position at which the trailing end grasping portion 36, which is holding the trailing end of the printing plate 12, opposes the trailing end grasping portion attaching/removing unit 32. The trailing end grasping portion attaching/removing unit 32 removes the trailing end grasping portion 36 from the rotating drum 16. In this way, the trailing end of the printing plate 12 is freed.

Thereafter, by rotating the rotating drum 16 in the direction of removing the printing plate 12, the printing plate 12 is expelled, from the trailing end side thereof, to the plate discharging guide 22 of the conveying guide unit 18 along a direction tangential to the rotating drum 16. Thereafter, the printing plate 12 is conveyed to the developing device which is the subsequent process.

(Structure of Separating/Removing/Conveying Section)

The removing/conveying section 15 is one example of the removing device. As shown in FIG. 1, a cassette 38, which is parallel to the surface on which the device is placed, is provided in the removing/conveying section 15. In the present first embodiment, one cassette 38 is provided. However, a plurality of cassettes 38 may be provided one above the other and in a drawer-like manner.

Figure 2:
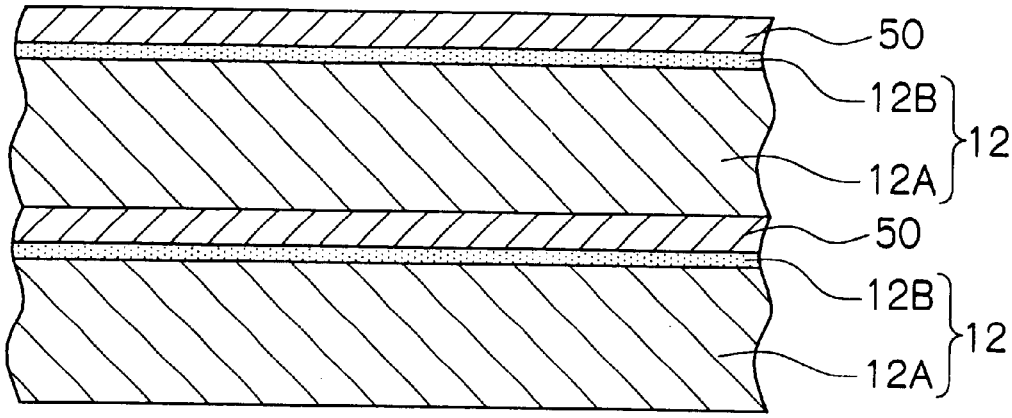
FIG. 2 is a side view showing a state in which interleaf sheets and printing plates are stacked in a cassette which is applied to the automatic printing plate exposure device relating to the first embodiment.

As shown in FIG. 2, the printing plates 12 which are accommodated in the cassette 38 are disposed such that an emulsion surface 12B of the printing plate 12, which is provided on a support 12A, faces upward. The emulsion surface 12B is one example of the image recording surface. Further, thin-film-like, sheet-shaped interleaf sheets 50, which are for protecting the emulsion surfaces 12B, are provided between the stacked printing plates 12.

As shown in FIG. 1, the removing/conveying section 15 is formed by a sucking removing portion 15A which removes the printing plate 12 (and the interleaf sheet 50) from the cassette 38 by sucking the printing plate 12 (and the interleaf sheet 50), and a conveying portion 15B for feeding the printing plate 12, which has been sucked at the sucking removing portion 15A, to the exposure section 14.

In the sucking removing portion 15A, a plurality of suction cups 52 are disposed at predetermined pitch intervals at a base plate (not shown) which is provided along the transverse direction of the printing plate 12. The suction cups 52 are one example of a take-out device. The suction cups 52 are classified into a plurality of systems. In this way, on the basis of the size of the printing plate 12, a system is selected and a sucking function is imparted to the selected system such that the printing plate 12 can thereby be sucked in a well-balanced manner.

Here, at the time when the suction cups 52 suck the printing plate 12, the suction cups 52 suck the printing plate 12 from above the interleaf sheet 50 provided on top of the printing plate 12.

The base plate is raised in a state in which the interleaf sheet 50 and the printing plate 12 are sucked by the suction cups 52. At this time, the suction cups 52 can take out the interleaf sheet 50 and the printing plate 12 as a pair from the cassette 38 due to a separating plate 38A which is provided at a corner portion of the cassette 38.

The interleaf sheet 50 and the printing plate 12 which have been taken out are transferred to the conveying rollers 108.

Due to the driving force of the conveying rollers 108, the interleaf sheet 50 and the printing plate 12 move substantially horizontally along the guide plate 109.

A belt 56 of a belt conveyor unit 54, which forms a portion of the conveying portion 15B, opposes the guide plate 109 with the conveying path of the interleaf sheet 50 and the printing plate 12 disposed between the belt 56 and the guide plate 109. The belt 56 is an example of a conveying device. The belt 56 is trained about a pair of small rollers 58 and a pair of large rollers 60. Due to the driving force of an unillustrated driving means, the belt 56 is driven in the direction of arrow C in FIG. 1.

Figure 3A:
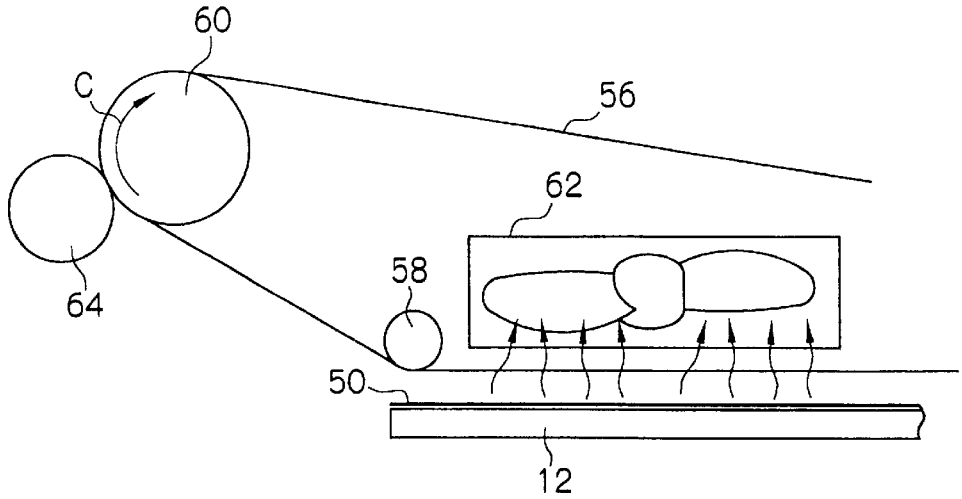
FIG. 3A is a side view showing a mechanism for peeling an interleaf sheet and a printing plate, at the time that the interleaf sheet and the printing plate are conveyed.
Figure 3B:
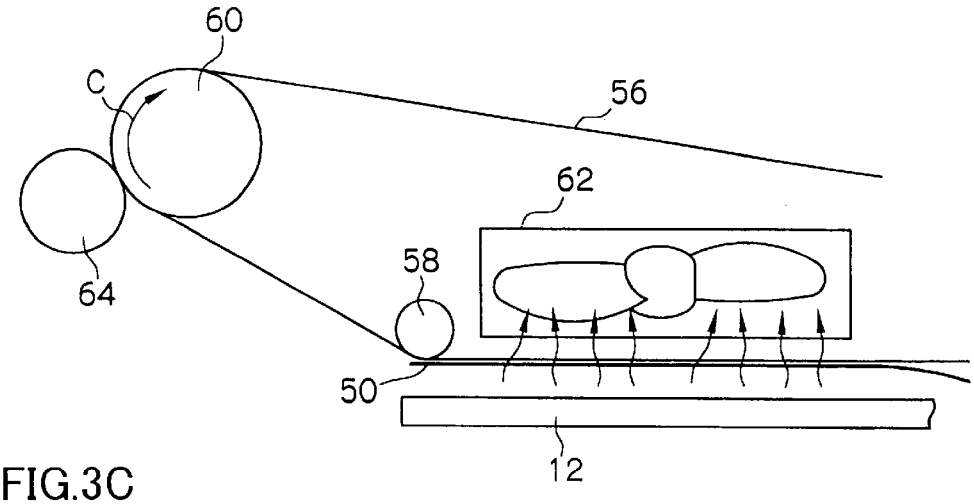
FIG. 3B is a side view showing the mechanism for peeling the interleaf sheet and the printing plate, at the time that the interleaf sheet is peeled from the printing plate.

A fan 62 is disposed at a position opposing the guide plate 109 (between the pair of small rollers 58), within the endless loop formed by the belt 56. The fan 62 is one example of a peeling device. The fan 62 is driven so as to suck-in air from the guide plate 109 side, and the belt 56 is mesh-like. Therefore, the suction force is force which sucks the interleaf sheet 50 which is on the conveying path. Here, because the interleaf sheet 50 is fit tightly to the printing plate 12 due to so-called static electricity (the state shown in FIG. 3A), when the interleaf sheet 50 is sucked by the fan 62, the interleaf sheet 50 is peeled off from the printing plate 12 and is sucked so as to be held against the belt 56 (the state shown in FIG. 3B).

The interleaf sheet 50, which is sucked and held against the belt 56, is conveyed together with the belt 56, and is inverted while being nipped by a roller pair 64 which contacts the large roller 60 and which is a portion of the belt conveyor unit 54. The interleaf sheet 50 is then guided by a guide plate 66 and fed into an unillustrated discard box (refer to the state shown in FIG. 3C). The roller pair 64 and the guide plate 66 are examples of members included in the interleaf sheet discarding device.

On the other hand, the printing plate 12 passes beneath the roller pair 64, and is transferred to the plate supplying guide 20.

The operation of the first embodiment will be described hereinafter.

When the printing plate 12 is to be removed from the cassette 38, the suction cups 52 are lowered from above a vicinity of the exposure section 14 side end portion of the cassette 38, and contact the interleaf sheet 50 which is the uppermost material in the cassette 38. In this state, sucking by the suction cups 52 is started, and raising of the suction cups 52 is started. During this raising, the suction cups 52 suck, together with the interleaf sheet 50 which is the topmost layer, the printing plate 12 which is disposed directly beneath that interleaf sheet 50.

Here, there are cases in which, when the interleaf sheet 50 and the printing plate 12 move away from the cassette 38, the interleaf sheet 50 or the printing plate 12 therebeneath stick to the sucked printing plate 12 due to static electricity. At this time, the sticking interleaf sheet 50 or printing plate 12 is separated from the sucked printing plate 12 by the separating plate 38A provided at the cassette 38. In this way, only the interleaf sheet 50 which is the uppermost layer and which is receiving the suction force, and the printing plate 12 directly therebeneath, are taken out from the cassette 38.

The interleaf sheet 50 and the printing plate 12 which have been taken out by the suction cups 52 are transferred to the conveying rollers 108. The transferred interleaf sheet 50 and printing plate 12 are, in a state in which they are still superposed together, guided by the guide plate 109 and conveyed in a substantially horizontal state in the direction toward the exposure section 14.

Here, it is necessary to convey only the printing plate 12 to the exposure section 14, and the interleaf sheet 50 is not needed. Thus, in the present first embodiment, the belt conveyor unit 54 is provided so as to oppose the guide plate 109.

The belt 56 of the belt conveyor unit 54 is mesh-like. By driving the fan 62 which is provided within the endless loop, the interleaf sheet 50 is sucked by the fan 62. Namely, the interleaf sheet 50 only sticks to the printing plate 12 due to so-called static electricity. Therefore, if, in the state shown in FIG. 3A, the interleaf sheet 50 receives the suction force of the fan 62, the suction force prevails over the sticking force caused by the static electricity, and the interleaf sheet 50 can be peeled off from the printing plate 12 (see FIG. 3B).

Figure 3C:
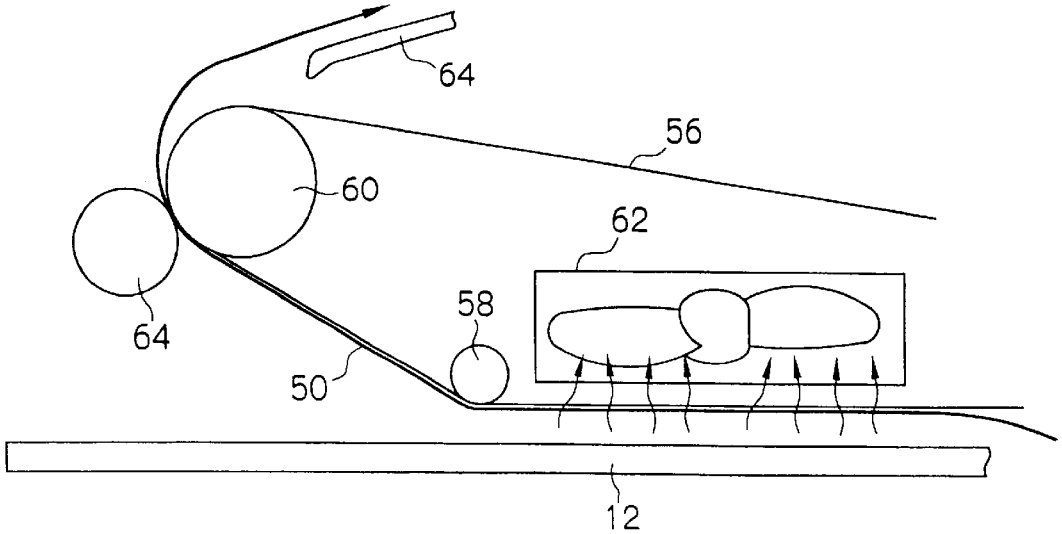
FIG. 3C is a side view showing the mechanism for peeling the interleaf sheet and the printing plate, at the time when the interleaf sheet and the printing plate are separated and conveyed along separate paths.

As the belt 56 is driven, the interleaf sheet 50 which has been peeled off is conveyed, and is inverted by being nipped by the roller pair 64 and the large roller 60, and is discarded in the discard box (see FIG. 3C).

On the other hand, the printing plate 12 continues to be conveyed substantially horizontally on the guide plate 109, and is fed to the plate supplying guide 20.

The printing plate 12 on the plate supplying guide 20 is fed to the rotating drum 16, and the leading end portion of the printing plate 12 is held by the leading end grasping portion 26. In this state, due to the rotating drum 16 rotating, the printing plate 12 is trained tightly onto the peripheral surface of the rotating drum 16. Thereafter, the trailing end of the printing plate 12 is held by the trailing end grasping portion 36. Preparations for exposure are thereby completed.

In this state, image data is read, and exposure processing by the light beam from the recording head portion 37 is started. The exposure processing is so-called scan-exposure in which the recording head portion 37 is moved in the axial direction of the rotating drum 16 while the rotating drum 16 is rotated at high speed (main scanning).

When exposure processing is completed, the conveying guide unit 18 is switched (the plate discharging guide 22 is made to correspond to the rotating drum 16). Next, the printing plate 12 which is trained on the rotating drum 16 is discharged out from a direction tangential to the rotating drum 16. At this time, the printing plate 12 is fed to the plate discharging guide 22.

When the printing plate 12 is fed to the plate discharging guide 22, the conveying guide unit 18 is switched such that the plate discharging guide 22 is made to correspond to the discharge opening, and the printing plate 12 is discharged. The developing section is provided in the discharging direction, and thus, the printing plate 12 is then subjected to developing processing.

Figure 4:
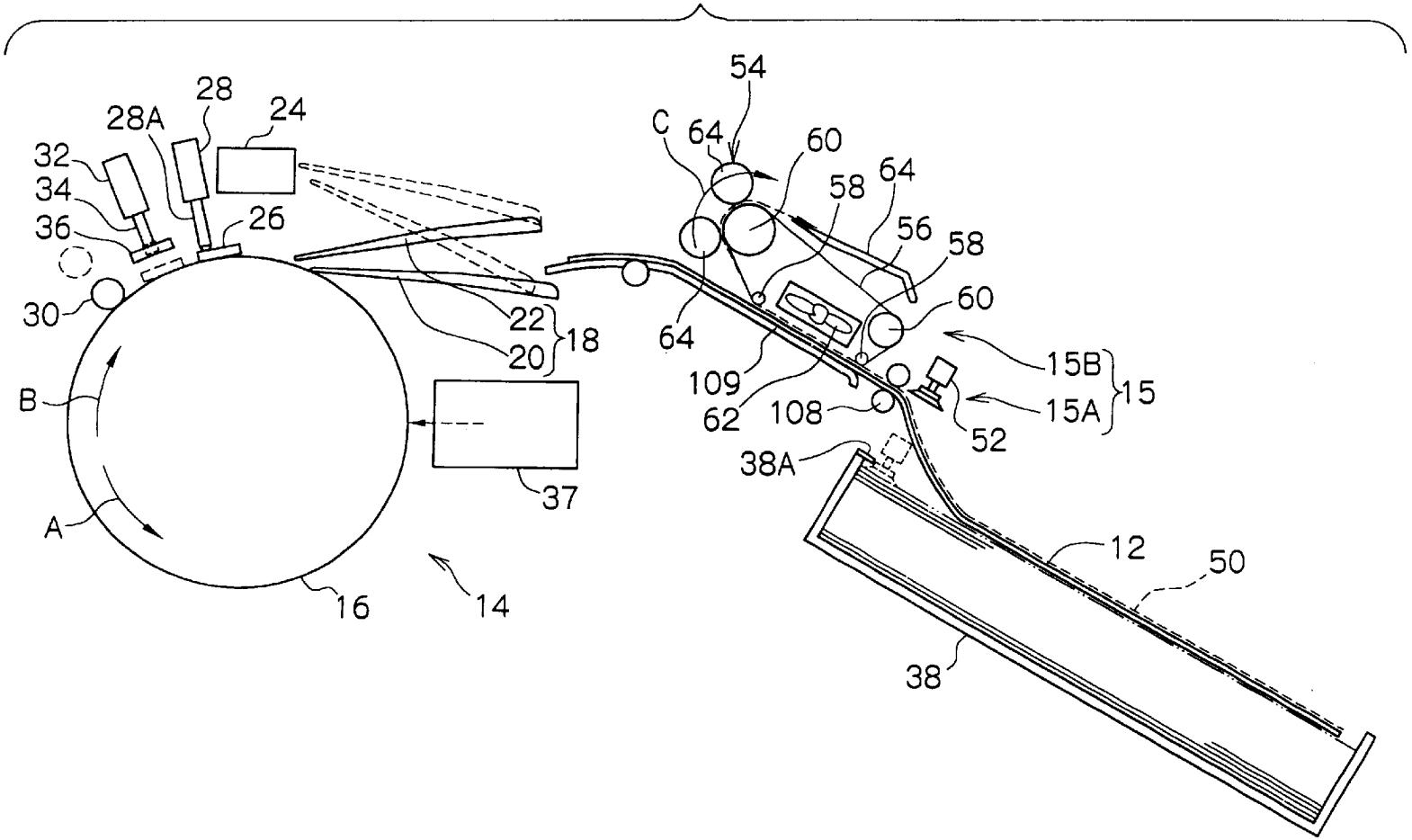
FIG. 4 is a schematic diagram showing an automatic printing plate exposure device relating to a modified example of the first embodiment.

In the above-described first embodiment, an example was described in which the cassette 38 is disposed substantially horizontally. However, as shown in FIG. 4, the cassette 38 may be disposed in a substantially inclined state. In this case, with the same structure, the interleaf sheet 50 and the printing plate 12 can be taken out simultaneously from the cassette 38, and while being guided on the guide plate 109, the interleaf sheet 50 can be sucked by the fan 62 and peeled off from the printing plate 12.

(Second Embodiment)

A second embodiment of the present invention will be described hereinafter. Note that, in the second embodiment, the same structural portions as in the first embodiment are denoted by the same reference numerals, and description thereof is omitted.

The feature of the present second embodiment is that the printing plates 12 within the cassette 38 are accommodated with the emulsion surfaces 12B thereof facing downward. This structure is a conventionally-existing structure in which the suction cups 52 contact the reverse surface of the printing plate 12 and take out the printing plate 12 so as to not contact the emulsion surface 12B.

Figure 5:
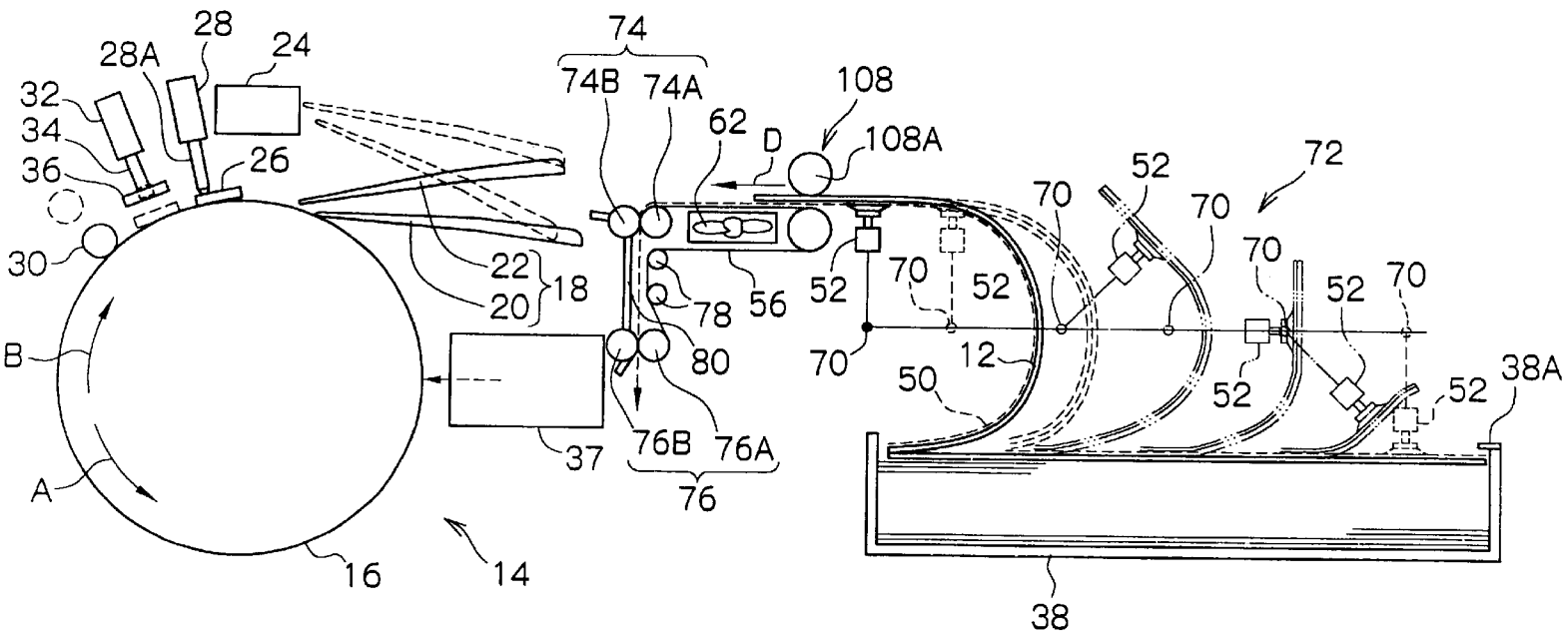
FIG. 5 is a schematic diagram showing an automatic printing plate exposure device relating to a second embodiment.

As shown in FIG. 5, a moving mechanism 72 is provided above the cassette 38. In the moving mechanism 72, the suction cups 52 are supported at base points 70 in a state in which the suction cups 52 hang downward. The moving mechanism 72 moves the base points 70 substantially horizontally in the left-right direction of the cassette 38 in FIG. 5.

The moving mechanism 72 is structured by a plate which supports the plurality of suction cups 52 along the transverse direction of the cassette 38, and a pair of rails across which the plate spans. (The plate and the rails are not illustrated.)

The base points 70 which support the suction cups 52 are rotatable. Here, when the printing plate 12 is to be taken out from the cassette 38, the plate to which the suction cups 52 are mounted is positioned on the rails at the right end portion, in FIG. 5, of the cassette 38.

Figure 6:
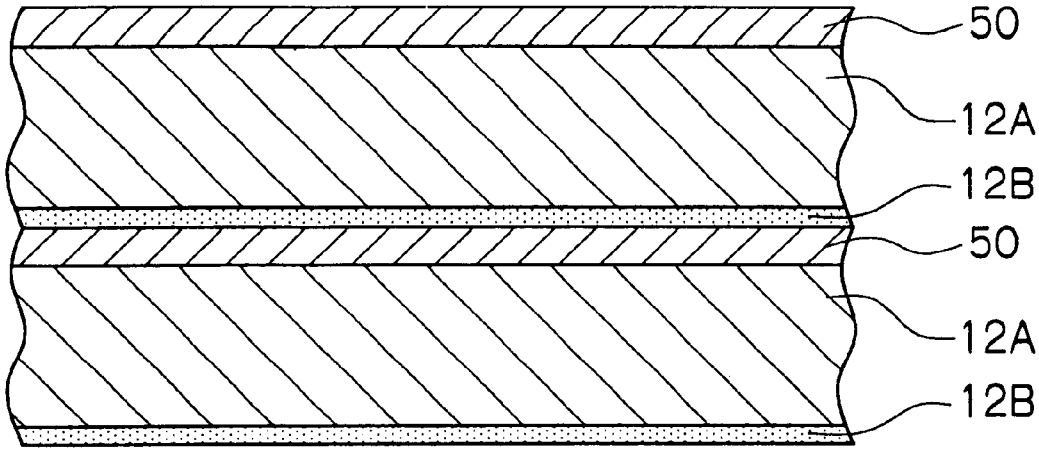
FIG. 6 is a side view showing a state in which interleaf sheets and printing plates are stacked in a cassette which is applied to the automatic printing plate exposure device relating to the second embodiment.

As shown in FIG. 6, the interleaf sheets 50 and the printing plates 12 are stacked alternately in the cassette 38 with the uppermost layer being the interleaf sheet 50 and the next layer being the printing plate 12 which is disposed with the emulsion surface 12B thereof facing downward.

Thus, the suction cups 52 directly contact the interleaf sheet 50 which is the uppermost material within the cassette 38.

When suction force is imparted to the suction cups 52 at the point in time when they contact the uppermost interleaf sheet 50, the suction force is applied to the uppermost interleaf sheet 50, as well as to the printing plate 12 immediately therebeneath. The interleaf sheet 50 and the printing plate 12 are thereby sucked and raised up as a pair. Note that, although the raising of the suction cups 52 is omitted from illustration in FIG. 5, the suction cups 52 rise up at least to a position at which the interleaf sheets 50 and the printing plates 12, which are other than and which are beneath the interleaf sheet 50 and the printing plate 12 which are being sucked, can be separated by the separating plate 38A provided at the cassette 38.

In the state in which this separating by the separating plate 38A has been completed, the plate supporting the suction cups 52 begins to rotate counterclockwise in FIG. 5 around the base points 70, and begins to move toward the left, in FIG. 5, of the cassette 38 along the rails. In this way, the suction points of the suction cups 52 move while tracing a so-called cycloid curve.

When the suction cups 52 have been rotated by 180°, the interleaf sheet 50 and the printing plate 12 are curved in a sideways U shape such that the interleaf sheet 50 is at the lower side and the printing plate 12 is at the upper side in the state shown in FIG. 5, and are transferred to the conveying rollers 108.

The belt 56 is trained around the lower roller of the conveying rollers 108. The belt 56 is mesh-like, and is also trained around a roller 74A which is the right side roller of a pair of rollers 74 provided in a vicinity of the conveying guide 18 of the exposure section 14.

A pair of rollers 76 is provided beneath the pair of rollers 74. The belt 56 is trained around a right side roller 76A of the lower rollers 76, and along a pair of small rollers 78 so as to form a substantially L-shaped loop overall, and is driven in the direction of arrow D in FIG. 5.

Note that a guide plate 80 is provided between a left side roller 74B of the upper pair of rollers 74 and a left side roller 76B of the lower pair of rollers 76.

The fan 62 is provided at the inner side of the belt 56 which forms a loop. The fan 62 sucks the interleaf sheet 50, which is being conveyed on the surface of the belt 56, via the mesh holes of the belt 56.

Due to this sucking, the sticking together of the interleaf sheet 50 and the printing plate 12 is cancelled. Only the interleaf sheet 50 is guided between the upper pair of rollers 74, is fed to the lower pair of rollers 76, and is discarded.

On the other hand, the printing plate 12 passes above the upper pair of rollers 74 and is fed to the plate supplying guide 20.

In this way, in the present second embodiment, even when a cassette 38 is used which accommodates the printing plates 12 with the emulsion surfaces 12B thereof facing downward, the interleaf sheet 50 and the printing plate 12, which are positioned in the cassette 38 with the interleaf sheet 50 disposed on top of the printing plate 12, can be inverted along a locus of movement which runs along a cycloid curve. Thereafter, the interleaf sheet 50 can be peeled off, and the printing plate 12 can be conveyed to the exposure section 14.

Figure 7A:
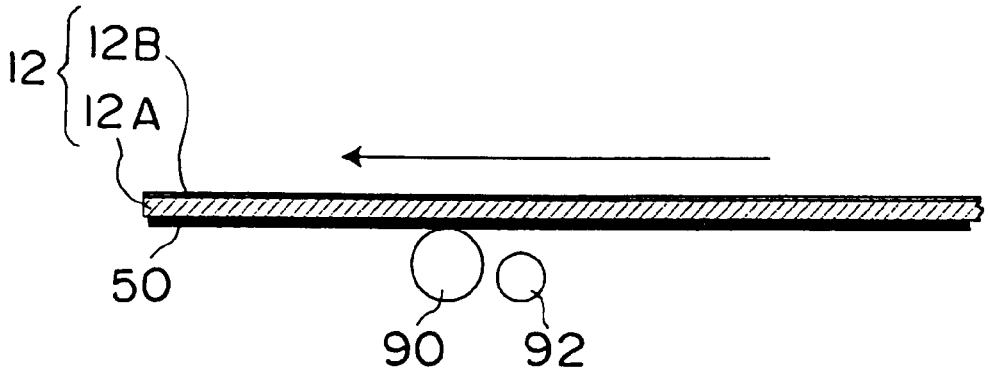
FIGS. 7A and 7B are schematic diagrams showing a modified example of interleaf sheet peeling in the automatic printing plate exposure device relating to the second embodiment.
Figure 7B:
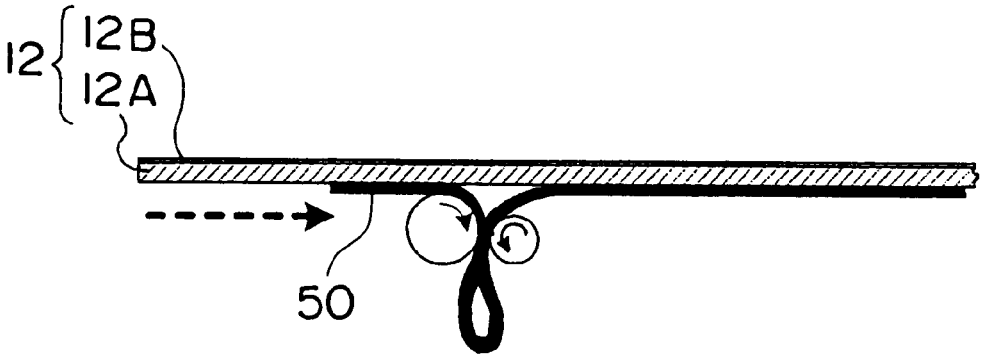

In the above-described second embodiment, the fan 62 is disposed at the inner side of the belt 56 which forms a loop, and the interleaf sheet 50 is peeled off by the suction force of the fan 62. However, a structure such as that shown in FIG. 7A may be utilized. In the structure of FIG. 7A, a pair of rollers which are a large roller 90 and a small roller 92 are disposed at the interleaf sheet 50 side (the underside). Due to the large roller 90 being rotated in the direction opposite to the conveying direction of the printing plate 12 (see FIG. 7B), the interleaf sheet 50 is drawn in between the pair of rollers 90, 92, and is peeled off. This structure may also be applied to a case in which the interleaf sheet 50 is the topmost layer as in the first embodiment.

As described above, in accordance with the first and second embodiments, the interleaf sheet 50 and the printing plate 12 are taken out simultaneously, and, while being conveyed along the conveying path leading to the exposure section 14, the interleaf sheet 50 is peeled off by being sucked by the fan 62. The peeled-off interleaf sheet 50 is discarded, and the printing plate 12 can be conveyed reliably to the exposure section 14. Therefore, there is no need for a separate mechanism for discarding the interleaf sheet 50, and the structure of the device can be made to be more simple. By simplifying the structure of the device, the external configuration and dimensions of the entire device can be made smaller, and the device can be set within a smaller space.

As described above, the present invention achieves the excellent effect that it is possible to convey only image recording materials to a subsequent process, without dividing the functions of removing image recording materials and removing interleaf sheets, and without scratching the image recording surfaces of the image recording materials.

What is claimed is:

1. A device for removing an image recording material in order to feed an image recording material out to a subsequent process from a cassette which accommodates, in an alternately stacked state, image recording materials, in each of which an image recording surface is provided on a support, and interleaf sheets, each of which is thin-film-like and protects the image recording surface, said image recording material removing device comprising:

a take-out device for simultaneously taking out from the cassette a pair of the image recording material and the interleaf sheet in a state in which the interleaf sheet is superposed on top of the image recording material;

a conveying device for conveying the image recording material and the interleaf sheet, which have been taken out by the take-out device, along a predetermined conveying path to the subsequent process;

a peeling device which peels the interleaf sheet from the image recording material while the interleaf sheet and the image recording material, which have been simultaneously taken-out, are in the midst of being conveyed along the conveying path to the subsequent process by the conveying device; and an interleaf sheet discarding device for discarding the interleaf sheet, which has been peeled off, along a path which is different from the conveying path to the subsequent process.

2. The device of claim 1, wherein the take-out device is formed by at least one suction cup which simultaneously sucks the interleaf sheet and the image recording material, and a moving device which makes said suction cup or cups approach and move away from the cassette.

3. The device of claim 2, wherein the image recording material is accommodated within the cassette with the image recording surface facing downward, and the moving device is a moving mechanism having a base point which supports the suction cup or cups in a state in which the suction cup or cups hangs downward, and which is rotatable, and which is movable in a direction.

4. The device of claim 2, wherein the image recording material having been originally accommodated in the cassette with the image recording surface facing upward and which has been taken out by the take-out device, is conveyed to the subsequent process by the conveying device in a state in which orientation of the image recording material is maintained.

5. The device of claim 4, wherein the peeling device is a pair of rollers of different sizes which are disposed above the interleaf sheet, and a large roller of the pair of rollers is rotatable in a direction opposite to a conveying direction of the image recording material such that the interleaf sheet is drawn in between the pair of rollers.

6. The device of claim 2, wherein the image recording material having been originally accommodated in the cassette with the image recording surface facing downward and which has been taken out by the take-out device, is conveyed to the subsequent process by the conveying device in a state in which orientation of the image recording material is inverted.

7. The device of claim 6, wherein the peeling device is a pair of rollers of different sizes which are disposed beneath the interleaf sheet, and a large roller of the pair of rollers is rotatable in a direction opposite to a conveying direction of the image recording material such that the interleaf sheet is drawn in between the pair of rollers.

8. The device of claim 2, wherein a plurality of suction cups are disposed at predetermined pitch intervals along a transverse direction of the image recording material, and the plurality of suction cups are classified into systems of plural functions.

9. The device of claim 1, wherein, the peeling device separates the interleaf sheet from the image recording material by suction force by air, and the interleaf sheet is peeled off from the image recording material.

10. The device of claim 9, wherein the peeling device is a fan-like shape.

11. The device of claim 1, wherein the cassette includes a separating plate at a corner portion of the cassette, and the conveying device includes a belt disposed so as to oppose the separating plate with respect to the conveying path, conveying rollers and a guide plate provided at a boundary of the subsequent process.

12. The device of claim 4, wherein the belt is composed of mesh-like material.

13. The device of claim 1, wherein the interleaf sheet discarding device includes a pair of rollers, a guide plate and the interleaf sheet, which has been conveyed in by the conveying device, is nipped and inverted by the pair of rollers, and is guided by the guide plate.

14. The device of claim 1, wherein the conveying device and the interleaf sheet discarding device form a common belt conveyor unit, and the belt conveyor unit includes a large roller and a belt which forms an endless loop, and at least one pair of rollers provided at the interleaf sheet discarding device is disposed so as to contact the large roller.

15. The device of claim 6, wherein the subsequent process is exposure processing, and the device for removing an image recording material is applicable to an automatic exposure device.

16. A method comprising:

taking out from a cassette a pair of an image recording material and an interleaf sheet simultaneously in a state in which the interleaf sheet is superposed on top of the image recording material using a take-out device;

conveying the image recording material and the interleaf sheet, which have been taken out by the take-out device, along a predetermined conveying path to the subsequent process using a conveying device;

peeling the interleaf sheet using a peeling device, from the image recording material while the interleaf sheet and the image recording material, which have been simultaneously taken-out, are in the midst of being conveyed along the conveying path to the subsequent process by the conveying device; and discarding the interleaf sheet, which has been peeled off, along a path which is different from the conveying path to the subsequent process using an interleaf sheet discarding device.

* * * * *